US011618619B2

(12) United States Patent
Biesecker, II et al.

(10) Patent No.: US 11,618,619 B2
(45) Date of Patent: Apr. 4, 2023

(54) CHILD-RESISTANT SINGLE WALL SQUEEZE AND TURN CLOSURE AND CONTAINER ASSEMBLY

(71) Applicant: Drug Plastics & Glass Company, Inc., Boyertown, PA (US)

(72) Inventors: Frederick N. Biesecker, II, Boyertown, PA (US); Nathaniel Koller, Boyertown, PA (US); Bruce T. Cleevely, Boyertown, PA (US); Douglas S. Camomile, Boyertown, PA (US); Lissa Biesecker Longacre, Boyertown, PA (US); Joshua T. Koehler, Boyertown, PA (US)

(73) Assignee: DRUG PLASTICS & GLASS COMPANY, INC., Boyertown, PA (US)

( * ) Notice: Subject to any disclaimer, the term of this patent is extended or adjusted under 35 U.S.C. 154(b) by 9 days.

(21) Appl. No.: 16/764,918

(22) PCT Filed: Nov. 20, 2018

(86) PCT No.: PCT/US2018/062026
§ 371 (c)(1),
(2) Date: May 18, 2020

(87) PCT Pub. No.: WO2019/104043
PCT Pub. Date: May 31, 2019

(65) Prior Publication Data

US 2020/0339320 A1 Oct. 29, 2020

Related U.S. Application Data

(60) Provisional application No. 62/589,032, filed on Nov. 21, 2017.

(51) Int. Cl.
*B65D 50/04* (2006.01)
*A61J 1/03* (2006.01)
*B65D 51/24* (2006.01)

(52) U.S. Cl.
CPC ..... *B65D 50/046* (2013.01); *A61J 1/03* (2013.01); *B65D 51/245* (2013.01)

(58) Field of Classification Search
CPC .. B65D 50/046; B65D 50/048; B65D 50/083; B65D 50/06; B65D 50/041;
(Continued)

(56) References Cited

U.S. PATENT DOCUMENTS 2,593,770 A * 4/1952 Kollsman ..... B67D 1/0418 141/46
3,827,592 A * 8/1974 Deussen ..... B65D 50/067 215/217
(Continued)

FOREIGN PATENT DOCUMENTS

CA 2408064 A1 * 4/2003 ..... B65D 51/20
DE 9312423 U1 * 2/1994 ..... B65D 35/12
(Continued)

OTHER PUBLICATIONS

Worth, J. (Oct. 12, 2017). Why proper wall thickness is crucial for defect-free parts. The Rodon Group. Retrieved Aug. 15, 2022, from https://www.rodongroup.com/blog/why-proper-wall-thickness-is-crucial-for-defect-free-parts (Year: 2017).*

*Primary Examiner* — J. Gregory Pickett
*Assistant Examiner* — Abigail Elizabeth Guidry
(74) *Attorney, Agent, or Firm* — Panitch Schwarze Belisario & Nadel LLP

(57) ABSTRACT

Child resistant closures are typically two-piece assemblies or squeeze and turn closures with an inside wall and an outside wall. The current squeeze and turn child resistant
(Continued)

closures are expensive and difficult for seniors to operate. The preferred design is a child-resistant single wall cap and container assembly that is preferably easy for seniors to open and difficult for children to open or is substantially child-resistant. In addition, due to the single wall of the cap and relatively low cap height, the preferred assembly is light, requires less material and relatively less expensive to manufacture than prior art container assemblies. Like many child resistant closure systems, the preferred container assembly design includes a container with specifically designed neck finish to lock the closure on the container. However, the preferred design includes two small lugs, which generally do not add significantly to the bottle complexity or bottle cost.

19 Claims, 15 Drawing Sheets

(58) Field of Classification Search
CPC ..... B65D 50/043; B65D 50/04; B65D 50/02; B65D 41/06; B65D 41/04; B65D 51/245; A61J 1/03
See application file for complete search history.

(56) References Cited

U.S. PATENT DOCUMENTS 3,979,016 A * 9/1976 Frater ..... B65D 21/022 206/508
3,993,209 A * 11/1976 Julian ..... B65D 50/046 215/216
4,172,533 A * 10/1979 Montgomery ..... B65D 50/046 215/216
4,365,722 A * 12/1982 Kramer ..... A61J 7/04 206/534
4,387,817 A * 6/1983 Wiles ..... B65D 50/043 215/217
4,456,136 A * 6/1984 Palsson ..... B65D 41/3409 215/216
4,512,484 A 4/1985 Mar
4,519,518 A * 5/1985 Wiles ..... B65D 41/0414 215/331
4,588,097 A * 5/1986 Hauser ..... B65D 50/045 215/216
4,630,743 A 12/1986 Wright
4,991,733 A * 2/1991 Marino ..... B65D 41/0471 215/216
5,197,621 A * 3/1993 Bartl ..... B65D 41/0471 215/331
5,238,130 A * 8/1993 Marques ..... B65D 50/046 215/217
5,284,273 A * 2/1994 Schreiber ..... B65D 47/263 222/39
5,449,077 A * 9/1995 Seidler ..... B65D 50/045 215/206
5,638,969 A * 6/1997 King ..... B65D 50/046 215/216
5,662,233 A * 9/1997 Reid ..... B65D 41/58 215/273
5,687,863 A * 11/1997 Kusz ..... B65D 41/0471 215/331
5,779,072 A * 7/1998 Krebs ..... B65D 50/046 215/219
5,803,287 A * 9/1998 Kusz ..... B65D 41/0471 215/331
5,836,466 A * 11/1998 Briere ..... B65D 50/046 215/216
5,915,576 A * 6/1999 Robinson ..... B65D 50/046 215/216
5,927,527 A * 7/1999 Montgomery ..... B65D 41/3447 215/219
6,152,315 A * 11/2000 Montgomery ..... B65D 50/046 215/216
6,168,035 B1 * 1/2001 McLelland ..... B65D 50/046 215/216
6,609,637 B1 * 8/2003 Suffa ..... B65D 41/0414 222/545
6,854,613 B2 2/2005 Biesecker et al.
7,182,213 B2 * 2/2007 King ..... B65D 41/0471 220/296
7,530,470 B1 * 5/2009 Houser ..... B65D 50/046 220/915
7,819,264 B2 * 10/2010 Brozell ..... B65D 50/043 215/DIG. 1
7,828,166 B1 * 11/2010 Sprick ..... B65D 50/046 215/209
8,051,999 B2 * 11/2011 Carmody ..... B65D 50/046 215/330
8,079,483 B2 * 12/2011 Brozell ..... B65D 41/0471 215/217
D653,281 S * 1/2012 Shih ..... D18/18
8,123,058 B2 * 2/2012 Brozell ..... B65D 41/0471 215/216
8,590,719 B2 11/2013 Sprishen et al.
D856,138 S 8/2019 Biesecker et al.
10,472,134 B1 * 11/2019 Bergida ..... B65D 41/0435
10,822,148 B2 * 11/2020 Sterling ..... B65D 55/024
2002/0125249 A1 * 9/2002 Baird-Smith ..... B65D 51/20 220/258.1
2002/0166834 A1 * 11/2002 Branson ..... B65D 50/046 215/216
2004/0222181 A1 * 11/2004 Biesecker ..... B65D 50/046 215/218
2005/0121406 A1 * 6/2005 Brozell ..... B65D 50/043 215/220
2005/0199572 A1 * 9/2005 Brozell ..... B65D 50/043 215/218
2005/0242055 A1 * 11/2005 Oh ..... B65D 41/0471 215/332
2006/0213860 A1 * 9/2006 Robinson ..... B65D 50/046 215/216
2007/0023380 A1 * 2/2007 Shingle ..... B65D 41/0421 215/217
2007/0045320 A1 * 3/2007 Biesecker ..... B65D 50/041 220/345.1
2010/0177988 A1 * 7/2010 Pitman ..... B65D 33/16 383/42
2011/0017741 A1 1/2011 Sprishen
2011/0094990 A1 * 4/2011 Sprishen ..... B65D 50/041 215/217
2012/0261418 A1 * 10/2012 Cronin ..... B65D 50/046 220/281
2013/0097973 A1 * 4/2013 McCoy ..... A61J 1/05 53/467
2014/0263339 A1 * 9/2014 Bates ..... B65D 41/0464 220/296
2015/0014269 A1 * 1/2015 Gillman ..... B65D 50/041 215/206
2015/0076103 A1 * 3/2015 Koller ..... B65D 50/046 215/220
2015/0175325 A1 * 6/2015 Martin ..... B65D 50/046 215/217
2015/0321804 A1 * 11/2015 Koller ..... B65D 1/0246 215/44
2016/0280429 A1 * 9/2016 Piscopo ..... B65D 50/046
2017/0113851 A1 * 4/2017 Martin ..... B65D 50/043
2020/0189803 A1 * 6/2020 Tapocik ..... B65D 50/046
2022/0112010 A1 * 4/2022 Darst ..... B65D 50/045
2022/0127061 A1 * 4/2022 Hoffman ..... B65D 51/248

FOREIGN PATENT DOCUMENTS

EP 0299886 A1 * 1/1989 ..... B65D 50/046
EP 2179942 A1 * 4/2010 ..... B65D 51/30
FR 2911329 A1 * 7/2008 ..... B65D 50/046
GB 2011869 A * 7/1979 ..... B65D 50/046

(56) References Cited

FOREIGN PATENT DOCUMENTS

| | | | | | |
|---|---|---|---|---|---|
| GB | 2125382 | A * | 3/1984 | ..... | B65D 41/3409 |
| WO | WO-2005037659 | A2 * | 4/2005 | ..... | B65D 50/046 |
| WO | WO-2009103947 | A1 * | 8/2009 | ..... | B65D 50/046 |

* cited by examiner

CHILD-RESISTANT SINGLE WALL SQUEEZE AND TURN CLOSURE AND CONTAINER ASSEMBLY

CROSS-REFERENCE TO RELATED APPLICATIONS

The present application is a Section 371 of International Patent Application No. PCT/US2018/062026, titled "Child Resistant Single Wall Squeeze and Turn Closure and Container Assembly" and filed Nov. 20, 2018 and claims the benefit of U.S. Provisional Patent Application No. 62/589,032, filed on Nov. 21, 2017 and titled "Child-Resistant Single Wall Squeeze and Turn Closure and Container Assembly" the entire contents of which are incorporated herein by reference in their entirety.

BACKGROUND OF THE INVENTION

Known child-resistant closures and container assemblies are typically constructed of two piece assemblies or squeeze and turn closures with an inside wall and an outside wall. The known squeeze and turn child-resistant closures are relatively expensive and can be difficult for seniors to operate. It is desirable to design, construct and implement a child-resistant closure and container assembly that addresses the shortcomings of known child-resistant closures and container assemblies.

BRIEF SUMMARY OF THE INVENTION

The preferred design for a single wall child-resistant closure and container assembly is relatively easy for seniors to open and relatively difficult for children to open, or is child-resistant. The closure and container assembly provides an audible click assuring the user that the cap is secured and in a locked position relative to the container. In addition, due to the single wall, the closure and container assembly is relatively light, requiring less material and is relatively less expensive to manufacture when compared to known child-resistant closures and container assemblies. Like many child resistant closure systems the preferred closure design includes a bottle with specifically designed neck finish to lock the closure onto the bottle or container. This preferred child-resistant container assembly includes two small lugs extending outwardly from the neck of the container and inwardly from the skirt of the cap or closure, which do not add significantly to the bottle or closure complexity or to the bottle or closure cost.

In another aspect, the preferred invention is directed to a lightweight container assembly wherein an operator squeezes opposing sides toward a longitudinal axis to open the container assembly. The container assembly includes a cap having a top and a skirt extending substantially perpendicularly from the top. The skirt has a first bulge and a second bulge extending radially outwardly relative to the longitudinal axis. The first bulge is positioned opposite the second bulge on the skirt. The cap also includes first and second cap lugs extending inwardly from the skirt. The first cap lug is positioned opposite the second cap lug on the skirt and the first and second cap lugs are spaced from the first and second bulges. A container has a body and a narrowed neck extending from the body. The neck defines a mouth at a top end of the neck. The container includes first and second container lugs extending radially outwardly from the neck. The first container lug is positioned opposite the second container lug on the neck. The first and second cap lugs interact with the first and second container lugs to block backward or reverse rotation of the cap relative to the container in a locked configuration, wherein the cap is in a relaxed configuration. In addition to the first and second lugs, the cap has a secondary set of lugs also extending inwardly from the skirt that are intended to stop the cap from over-rotating when applied to the container. The container additionally has two rotation-stop lugs or flat vertical surfaces that extend radially outwardly from the neck. While the cap is in the locked configuration, the rotation-stop lugs located on the cap interact with the rotation-stop lugs or surfaces on the container to stop further forward rotation of the cap relative to the container, and thus prevent over-tightening of the cap on the container, which may cause the container assembly to inadvertently come out of the locked configuration.

In another aspect, the preferred invention is directed to a child resistant closure assembly for limiting access to contents that are positioned in a container of the closure in a locked configuration. The closure assembly includes a cap having a top and a skirt extending substantially perpendicularly from the top and the container having a body and a narrowed neck extending from the body. The skirt is substantially cylindrical and has a first bulge and a second bulge extending radially outwardly relative to a longitudinal axis. The first bulge is positioned opposite the second bulge on the skirt. The cap includes first and second cap lugs extending inwardly from the skirt. The first cap lug is positioned opposite the second cap lug on the skirt and the first and second cap lugs are spaced from the first and second bulges. The first and second cap lugs and the first and second bulges are positioned proximate a terminal end of the skirt. The cap includes cap threads extending inwardly from the skirt. The cap threads are positioned proximate the top. The first and second cap lugs include cap ramp surfaces, cap locking surfaces and cap lug peak surfaces. The neck of the container defines a mouth at a top end. The container includes first and second container lugs extending radially outwardly from the neck. The first container lug is positioned opposite the second container lug on the neck. The first and second container lugs are positioned proximate a shoulder of the container and are spaced from the mouth. The first and second container lugs include container ramp surfaces, container locking surfaces and container lug peak surfaces. The first and second cap lugs interact with the first and second container lugs to block pivoting of the cap relative to the container in a locked configuration when the cap is in a relaxed configuration. The cap locking surface of the first cap lug faces the container locking surface of the first container lug in the locked configuration. The container includes container threads extending from the neck proximate the mouth.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
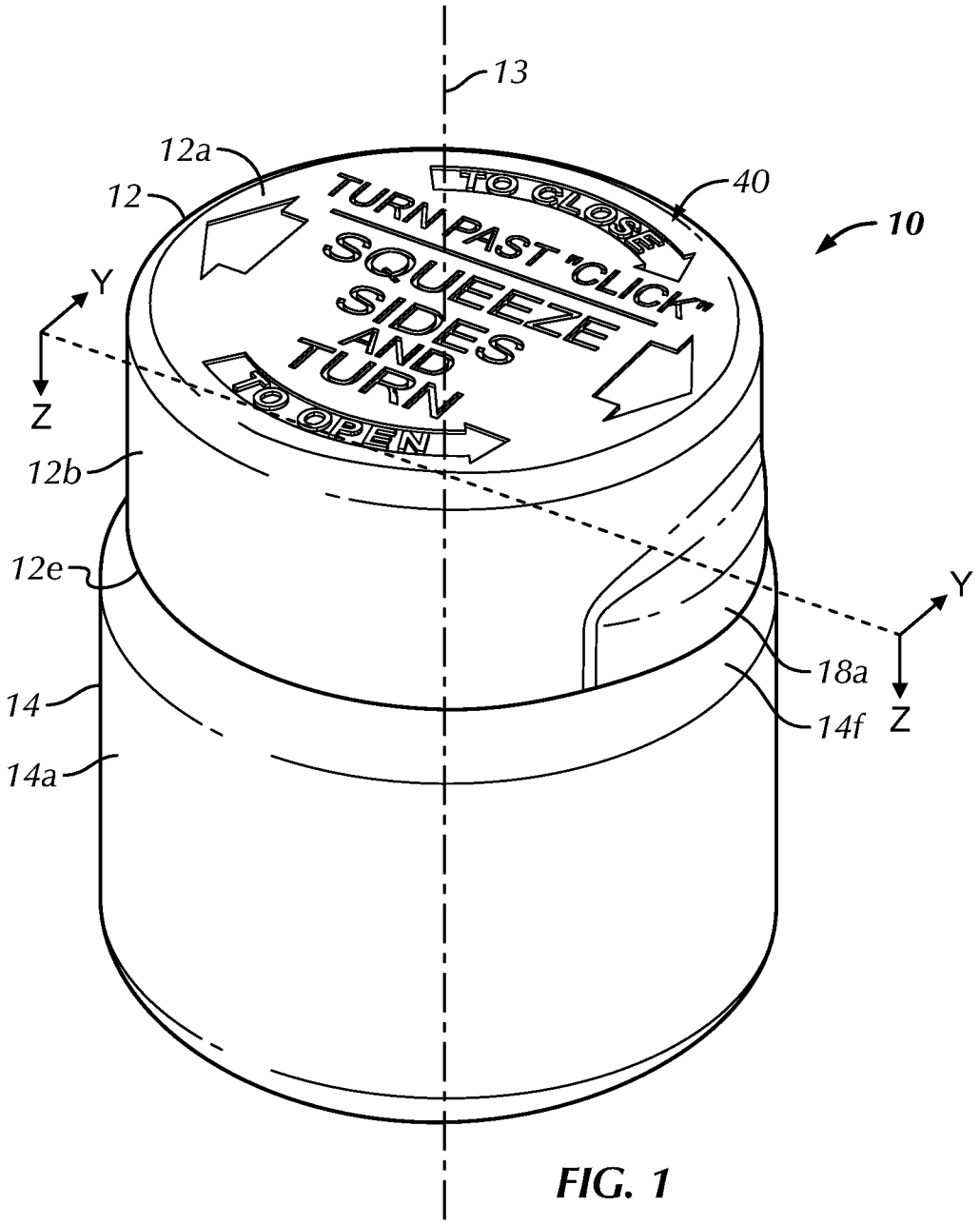
FIG. 1 is a top perspective view of a container assembly or closure assembly, including a cap and a container, in accordance with a preferred embodiment of the present invention.
Figure 2:
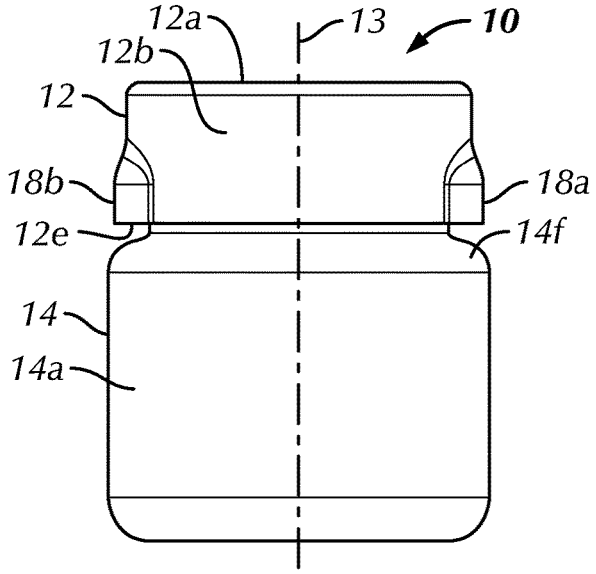
FIG. 2 is a front elevational view of the container assembly of FIG. 1, wherein the cap is in a relaxed configuration.
Figure 4:
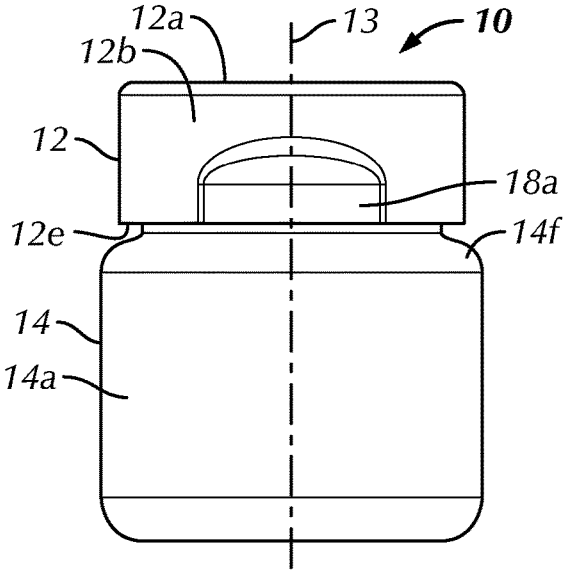
FIG. 4 is a side elevational view of the container assembly of FIG. 1, wherein the cap is in the relaxed configuration.
Figure 3:
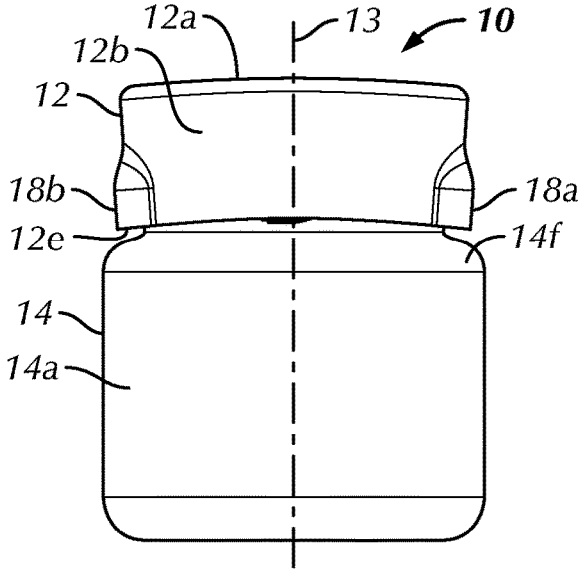
FIG. 3 is a front elevational view of the container assembly of FIG. 1, wherein the cap is in a squeezed configuration.
Figure 5:
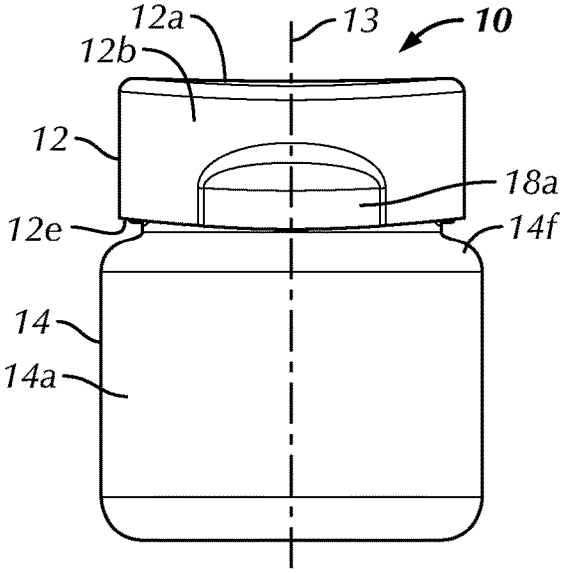
FIG. 5 is a side elevational view of the container assembly of FIG. 1, wherein the cap is in a squeezed configuration.
Figure 6:
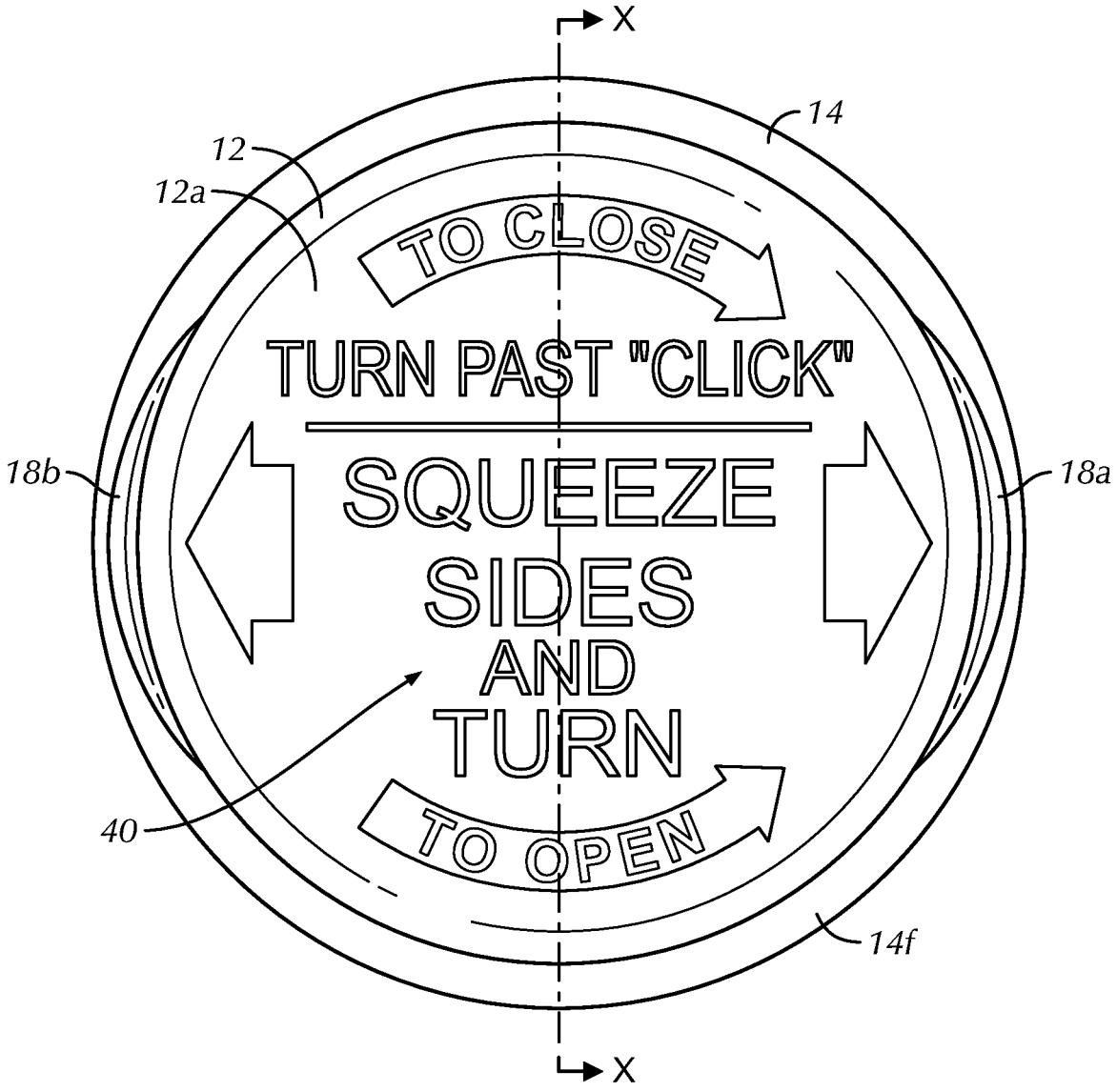
FIG. 6 is a top plan view of the container assembly of FIG. 1, wherein the cap is in a relaxed configuration.
Figure 7:
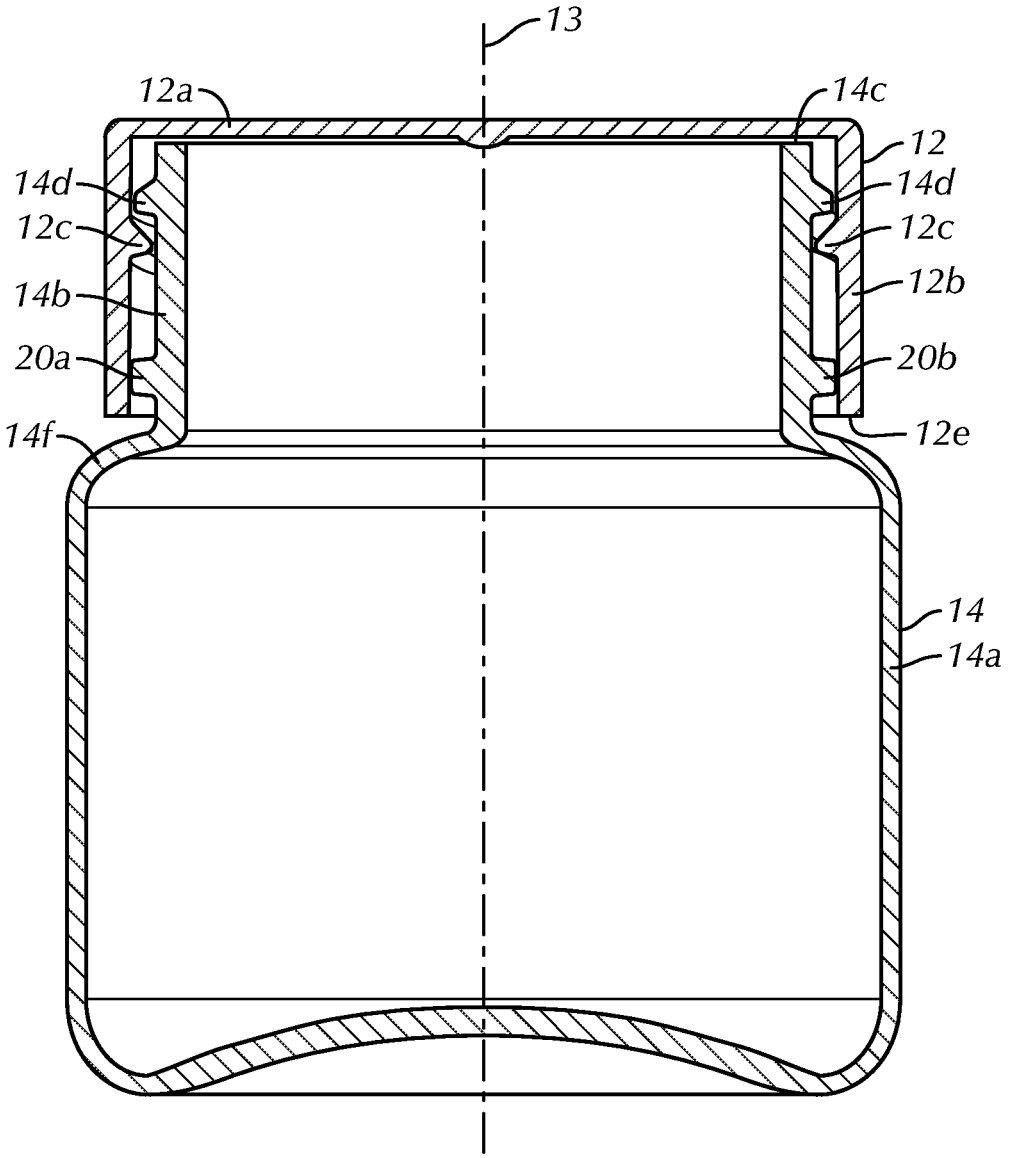
FIG. 7 is a cross-sectional view of the container assembly of FIG. 1, taken along line X-X of FIG. 6, wherein the cap and the container are positioned to show first and second container lugs.
Figure 8:
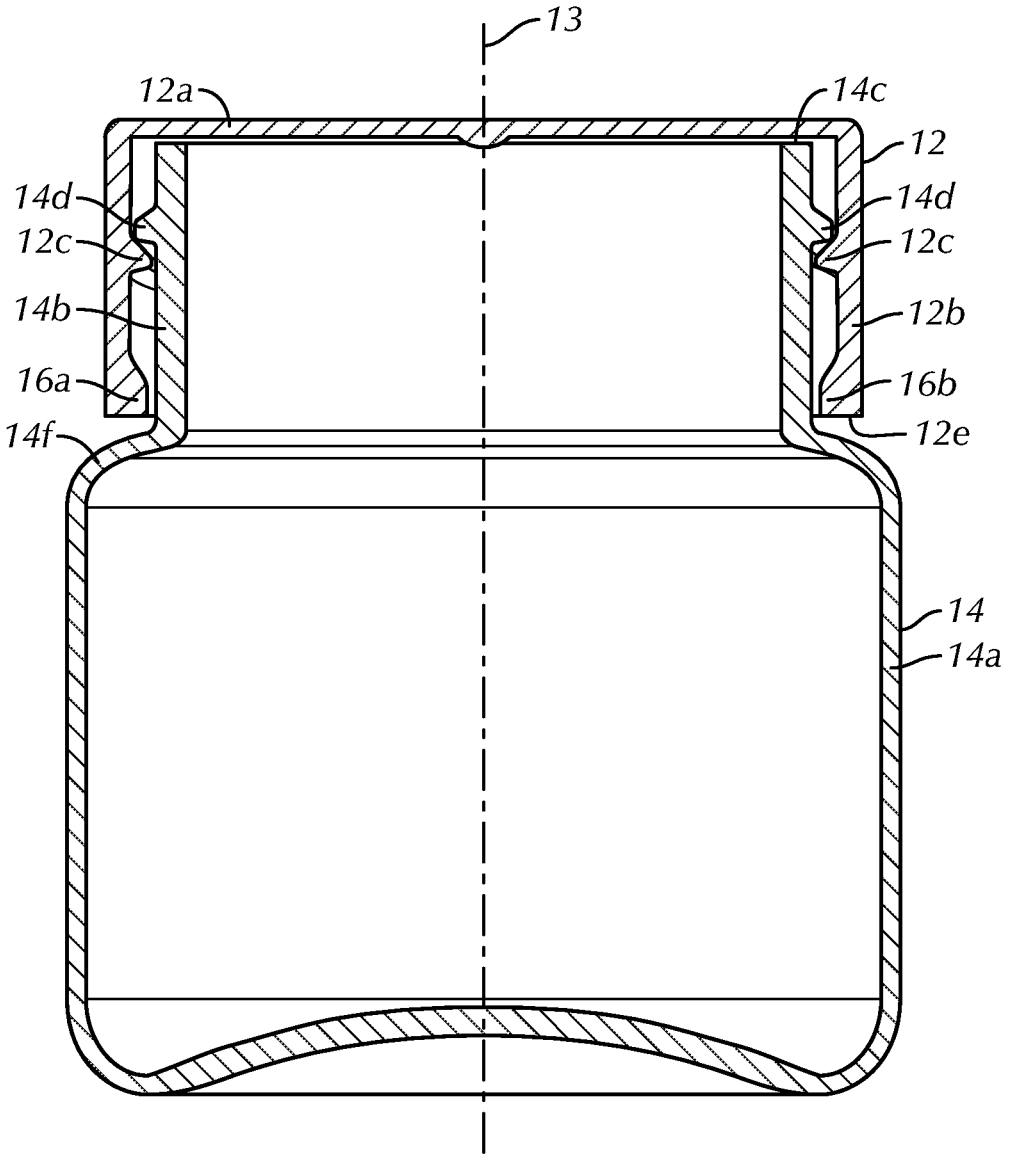
FIG. 8 is a cross-sectional view of the container assembly of FIG. 1, taken along line X-X of FIG. 6, wherein the cap and the container are positioned to show first and second cap lugs.
Figure 9:
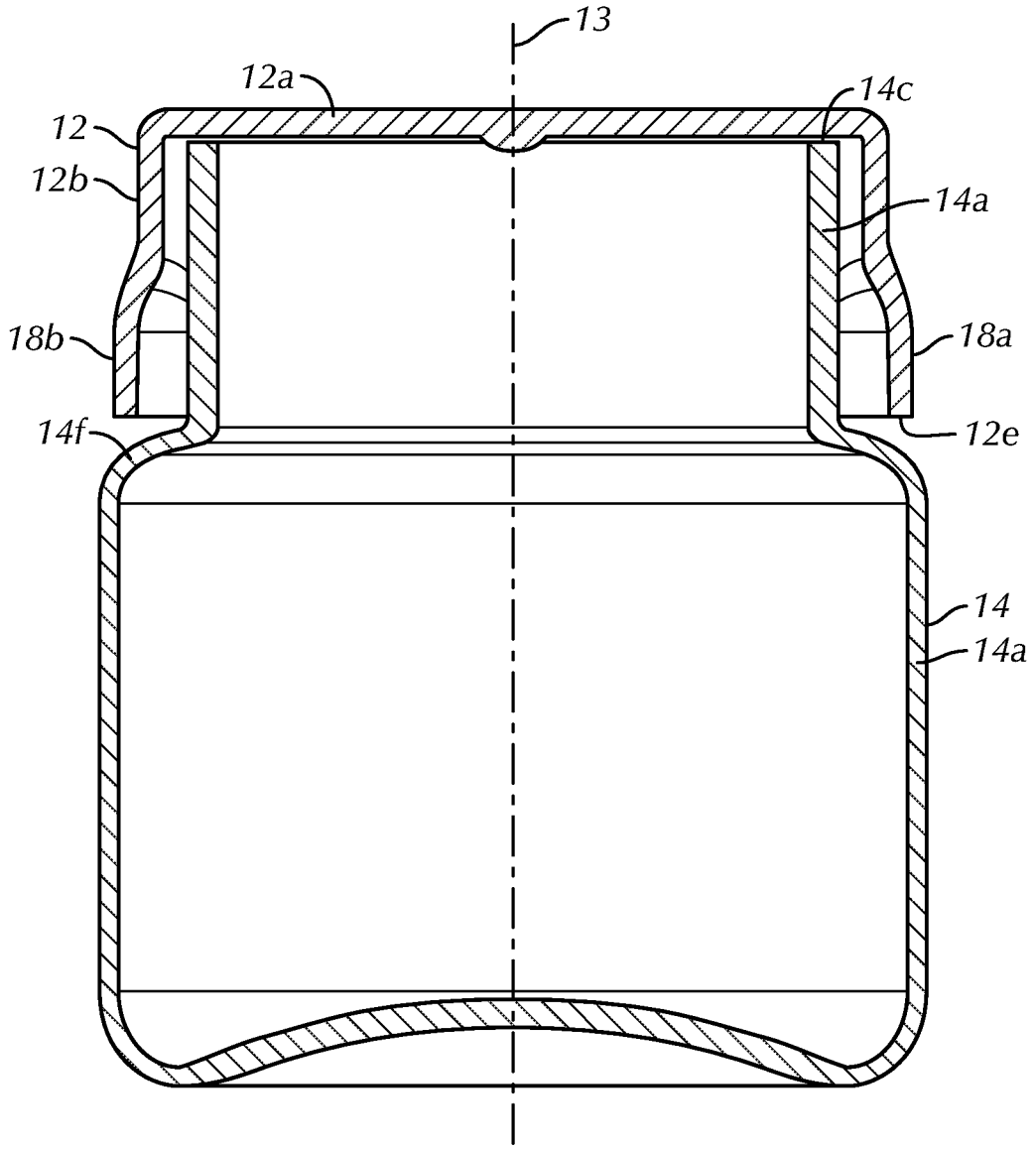
FIG. 9 is a cross-sectional view of the container assembly of FIG. 1, taken along line Y-Y of FIG. 1.
Figure 10:
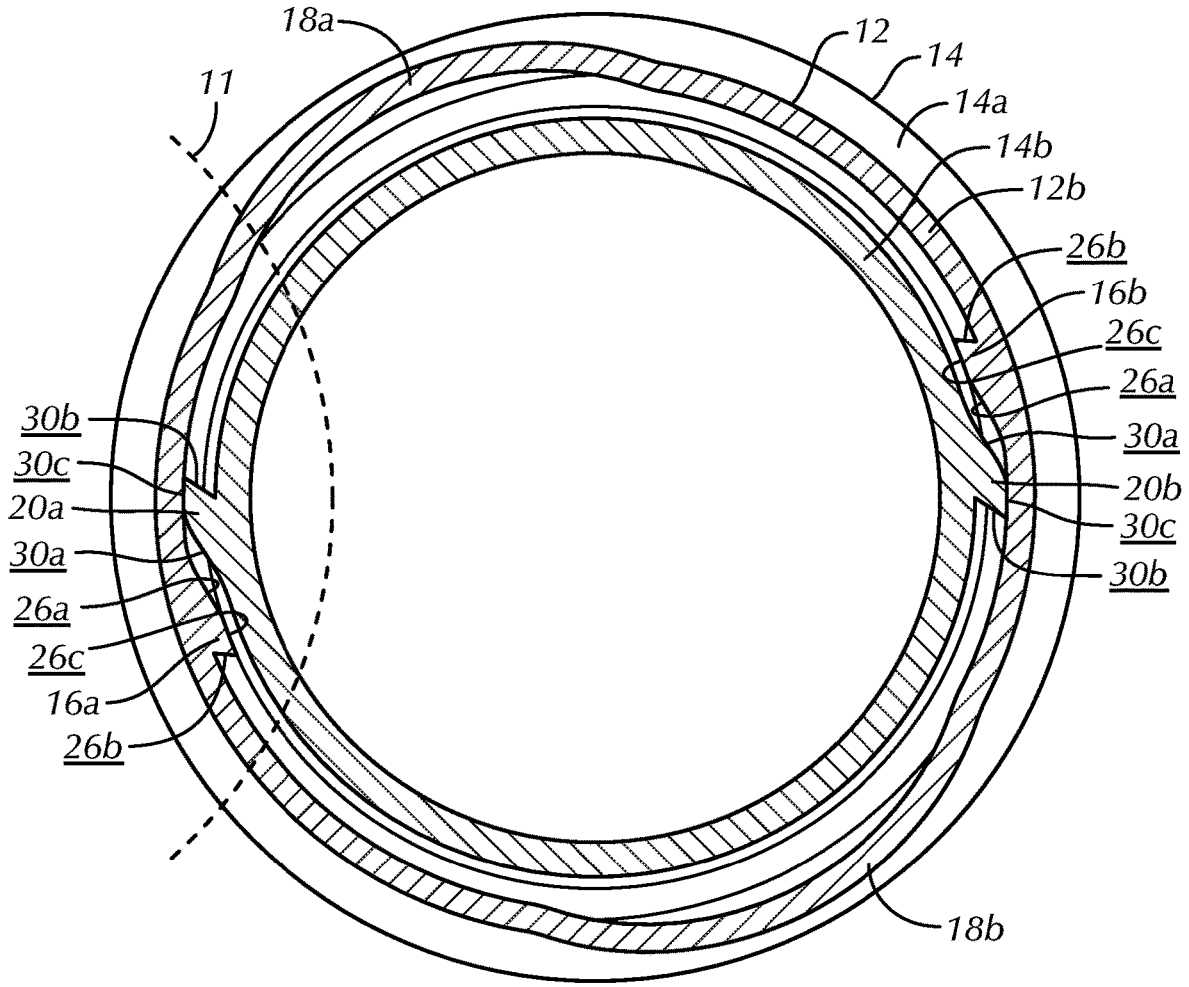
FIG. 10 is a cross-sectional view of the container assembly of FIG. 1, taken along line Z-Z of FIG. 1, wherein the container assembly is in an unlocked configuration.

Certain terminology is used in the following description for convenience only and is not limiting. Unless specifically set forth herein, the terms "a", "an" and "the" are not limited to one element but instead should be read as meaning "at least one". The words "right," "left," "lower," and "upper" designate directions in the drawings to which reference is made. The words "inwardly" or "distally" and "outwardly" or "proximally" refer to directions toward and away from, respectively, the geometric center or orientation of the device and related parts thereof. The terminology includes the above-listed words, derivatives thereof and words of similar import.

It should also be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally the same or similar, as would be understood by one having ordinary skill in the art. At a minimum, such references that include a numerical parameter would include variations that, using mathematical and industrial principles accepted in the art (e.g., rounding, measurement or other systematic errors, manufacturing tolerances, etc.), would not vary the least significant digit.

Referring to FIGS. 1-18, the preferred invention is directed to a child resistant, lightweight container or closure assembly, generally designated 10, including a cap 12 and a container 14. In an assembled configuration, the cap 12 and the container 14 define a longitudinal axis 13 that extends substantially centrally through the generally cylindrically-shaped skirt 12*b* of the cap 12 and body 14*a* of the container 14 (FIGS. 1-5 and 7-9). The child resistant, lightweight container or closure assembly 10 is operated by squeezing opposing sides of the cap 12 toward the longitudinal axis 13 to open the container assembly 10 or to permit an opening rotation of the cap 12 relative to the container 14 from a locked configuration (FIGS. 15 and 16), preferably by squeezing the cap 12 at opposing first and second cap bulges 18*a*, 18*b*, as will be described in greater detail below. The cap 12 includes a top 12*a* and the skirt 12*b* and the container 14 includes the body 14*a* and a neck 14*b*. The preferred container assembly 10 includes the cap 12 that has cap threads 12*c*, first and second cap locking lugs 16*a*, 16*b*, cap rotation-stop lugs 12*d* and first and the second bulges 18*a*, 18*b* on either side of the closure or cap 12 that bulge outwardly as part of the skirt 12*b* and these features are preferably, integrally formed or co-molded with the cap 12.

The cap threads 12*c* are preferably positioned proximate the top 12*a* and the first and second cap locking lugs 16*a*, 16*b* and the first and second bulges 18*a*, 18*b* are preferably positioned proximate a terminal end 12*e* of the skirt 12*b*. The cap threads 12*c* of the preferred embodiment are comprised of two opposing cap threads 12*c*, preferably quarter-turn threads, extending inwardly from the skirt 12*b* on opposing sides of the skirt 12*b*. The cap threads 12*c* preferably have the cap rotation stop lug 12*d* located at the trailing end of each of the cap threads 12*c*. The cap rotation-stop lug 12*d* has a generally flat vertical surface that extends inwardly from the skirt 12*b* and radially from the longitudinal axis 13. The preferred cap threads 12*c* are approximately quarter-turn threads 12*c* that generally fully engage or disengage upon rotation of the cap 12 relative to the container 14 following one-quarter turn. The preferred container or closure assembly 10 is not limited to including the cap thread 12*c* shown in the appended drawings and may include nearly any number of thread starts, as would be apparent to one having ordinary skill in the art based upon a review of the present disclosure.

The first and second bulges 18*a*, 18*b* preferably extend radially outwardly relative to the longitudinal axis 13 in the assembled configuration. The skirt 12*b* extends substantially perpendicularly and downwardly from the top 12*a* and has a ring or cylindrical-shape in the preferred embodiment with the top 12*a* being generally circular. The first bulge 18*a* is positioned opposite the second bulge 18*b* on the cap 12 and the first and second bulges 18*a*, 18*b* are co-molded or integrally formed with the skirt 12*b*. The first and second cap lugs 16*a*, 16*b* extend radially inwardly from the skirt 12*b* toward the longitudinal axis 13 in the assembled configuration. The first cap lug 16*a* is positioned opposite the second cap lug 16*b* on the skirt 12*b* or is spaced approximately one hundred eighty degrees from the second cap lug 16*b* on the skirt 12*b* relative to the longitudinal axis 13. The first and second cap lugs 16*a*, 16*b* are spaced from the first and second bulges 18*a*, 18*b*, preferably at approximately ninety degree angles relative to the longitudinal axis 13 on the skirt 12*b*, such that the first cap lug 16*a* is spaced from both the first and second bulges 18*a*, 18*b* at approximately ninety degrees at opposite sides of the first cap lug 16*a* and the second cap lug 16*b* is spaced from both the first and second bulges 18*a*, 18*b* at approximately ninety degrees relative to the longitudinal axis 13 at opposite sides of the second cap lug 16*b*. In the preferred embodiment, the first cap lug 16*a* is substantially equally spaced between the first and second bulges 18*a*, 18*b* and the second cap lug 16*b* is substantially equally spaced between the first and second bulges 18*a*, 18*b* on opposite sides of the skirt 12*b*. The first and second cap lugs 16*a*, 16*b* are not limited to being equally spaced from the first and second bulges 18*a*, 18*b*, but are preferably so spaced to maximize the deflection of the first and second cap lugs 16*a*, 16*b* radially outwardly in a squeezed configuration, as is described in greater detail below.

In the preferred embodiment, the first and second cap lugs 16*a*, 16*b* and the first and second bulges 18*a*, 18*b* are positioned proximate a terminal end 12*e* of the skirt 12*b*. The terminal end or open end 12*e* of the skirt 12*b* is spaced from the top 12*a* and is positioned near a shoulder 14*f* of the container 14 when the cap 12 is mounted to the container 14 in a locked configuration. The first and second cap lugs 16*a*, 16*b* and the first and second bulges 18*a*, 18*b* are preferably positioned proximate the terminal end 12*e* to facilitate radial flexing and elastic deformation of the terminal end 12*e* and the first and second bulges 18*a*, 18*b* relative to the top 12*a* and the neck 14*b* to operate the container assembly 10, as is described herein. In contrast, the cap threads 12*c* are positioned proximate the top 12*a* such that squeezing the first and second bulges 18*a*, 18*b* or orienting the cap 12 in the squeezed configuration (FIGS. 13 and 14) to elastically deform the skirt 12*b* near the first and second cap lugs 16*a*, 16*b* has limited impact on the positioning of the cap threads 12*c*.

The container 14 has the body 14*a* and the narrowed neck 14*b* extending from the body 14*a* that is separated from the body 14*a* by the shoulder 14*f*. The neck 14*b* defines a mouth 14*c* at a top end through which materials or contents for storage may be inserted into the body 14*a* or a storage cavity within the body 14*a*. The neck 14*b* also includes container threads 14*d* extending radially outwardly therefrom. The container threads 14*d* of the preferred embodiment are comprised of two opposing container threads 14*d* extending outwardly from the neck 14*b* on opposing sides of the neck 14*b*. The preferred container threads 14*d* are approximately quarter-turn threads 14*d* that generally fully engage or disengage upon rotation of the cap 12 relative to the container 14 following one-quarter turn of the cap 12 relative to the container 14. The container threads 14*d* engage and disengage with the cap threads 12*c* to facilitate this preferably one-quarter turn engagement and disengagement, although the cap threads 12*c* and container threads 14*d* are not so limited and may be comprised of any threads or connection mechanism that is able to engage and disengage the cap 12 from the container 14 and permits the additional functions of the preferred container assembly 10 described herein.

The container threads 14*d* each have a flat surface or container rotation-stop lug 14*e* located at the leading edge that interacts with the cap rotation-stop lugs 12*d*. The container rotation-stop lug 14*e* is generally vertical and extends outwardly from the container neck 14*b* and radially from the longitudinal axis 13. The container rotation-stop lugs 14*e* interact with the cap rotation-stop lugs 12*d* to block forward rotation of the cap 12 beyond a certain point relative to the container 14 in a locked configuration, wherein the cap 12 is in a relaxed configuration. The cap and container rotation-stop lugs 12*d*, 14*e* are preferably located at the leading ends of the container threads 14*d* and the trailing ends of the cap threads 12*c*, respectively, although they are not so limited in position or number and can be located at any location on the container 14 and cap 12 so long as the cap and container rotation-stop lugs 12*d*, 14*e* limit over-rotation of the cap 12 relative to the container 14 in the tightening direction of the container assembly 10.

The container 14 includes first and second container lugs 20*a*, 20*b* that extend radially outwardly from the neck 14*b*. The first container lug 20*a* is positioned opposite the second container lug 20*b* on the neck 14*b* or approximately one hundred eighty degrees rotationally relative to the longitudinal axis 13. The first and second cap lugs 16*a*, 16*b* interact with the first and second container lugs 20*a*, 20*b* to block reverse or opening pivoting of the cap 12 relative to the container 14 in a locked configuration, wherein the cap 12 is in a relaxed configuration.

The cap 12 and container 14 are preferably both constructed of a polymeric material such as polypropylene (PP), though other materials such as low or high density polyethylene, polyvinyl chloride (PVC), polystyrene, polyester terephthalate (PET), nylon, and the like may be similarly used. The cap 12 and container 14 are preferably individually molded with their herein described features co-molded with the cap 12 and the container 14, respectively.

The container assembly 10 is relatively easy to open and close for an individual having limited dexterity with their fingers and is also preferably child-resistant. Squeezing on the opposing first and second bulges 18*a*, 18*b* releases the first and second cap lugs 16*a*, 16*b* from the relaxed configuration, such that the first and second cap lugs 16*a*, 16*b* flex outwardly relative to the longitudinal axis 13. This flexing of the first and second cap lugs 16*a*, 16*b* outwardly clears the first and second cap lugs 16*a*, 16*b* relative to the first and second container lugs 20*a*, 20*b* in a mounted or assembled configuration, such that the cap 12 is rotatable relative to the container 14 for removal of the cap 12 from the container 14. The container assembly 10 can be opened relatively easily by squeezing the cap 12 at the first and second bulges 18*a*, 18*b* toward each other, thereby moving or flexing the first and second cap lugs 16*a*, 16*b* outwardly away from the first and second container lugs 20*a*, 20*b* and simultaneously pivoting or rotating the cap 12 relative to the container 14. This rotation is preferably a quarter-turn of the cap 12 relative to the container 14 about the longitudinal axis 13 on the quarter-turn cap threads 12*c* and container thread

14*d*. The preferred cap 12 has only one wall or skirt 12*b*, unlike many of other known closures that use a similar squeezing technique, but require two adjacent walls at the skirt to achieve the unlocking necessary to open the container assembly.

The first and second container lugs 20*a*, 20*b* are positioned near a bottom of the neck 14*b* proximate a shoulder 14*f* of the container 14. The first and second container lugs 20*a*, 20*b* are preferably positioned near or proximate the shoulder 14*f* at the bottom of the neck 14*b* for interaction with the first and second cap lugs 16*a*, 16*b* in operation. The first and second container lugs 20*a*, 20*b* are not limited to being positioned proximate the shoulder 14*f*, but are preferably spaced from the mouth 14*c* at a sufficient distance for interaction with the first and second cap lugs 16*a*, 16*b*, which are preferably spaced from the top 12*a*.

Figure 14:
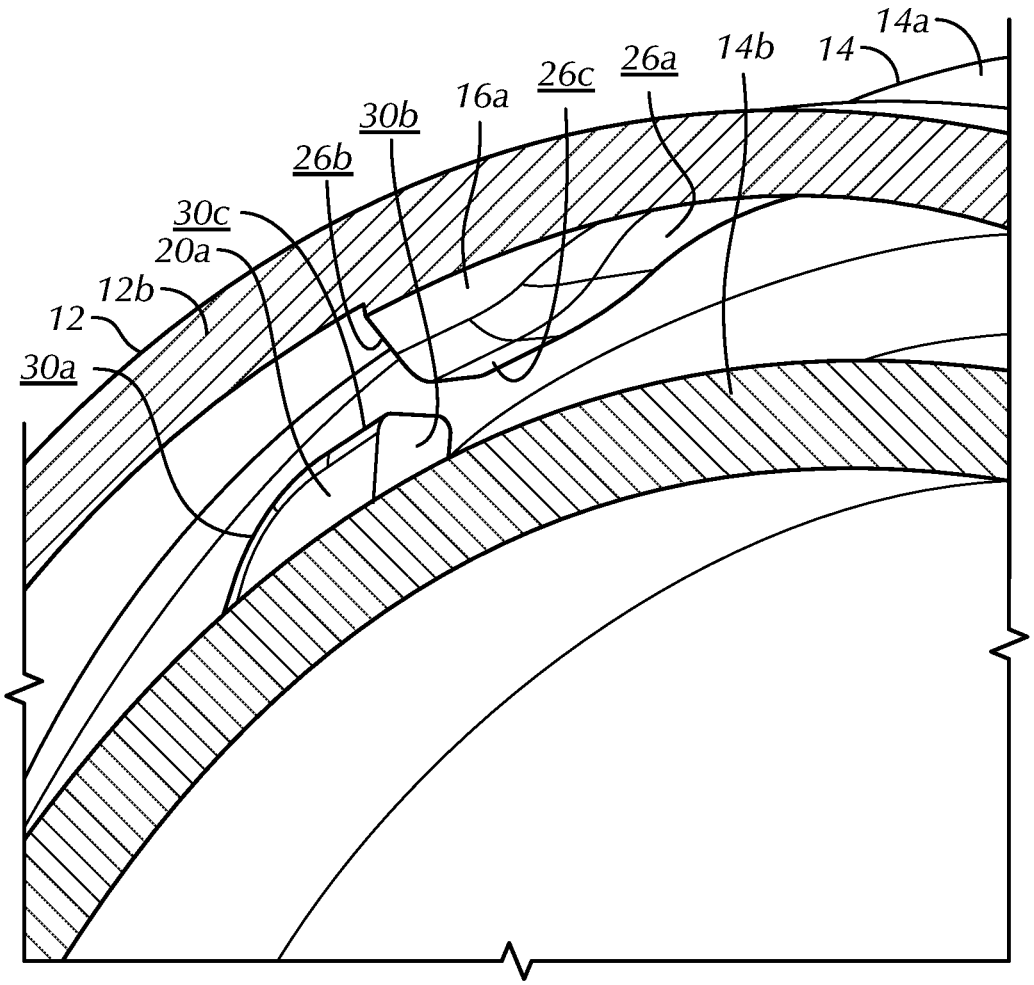
FIG. 14 is a magnified top perspective, cross-sectional view of the container assembly of FIG. 1, taken from within portion 14 of FIG. 13.
Figure 15:
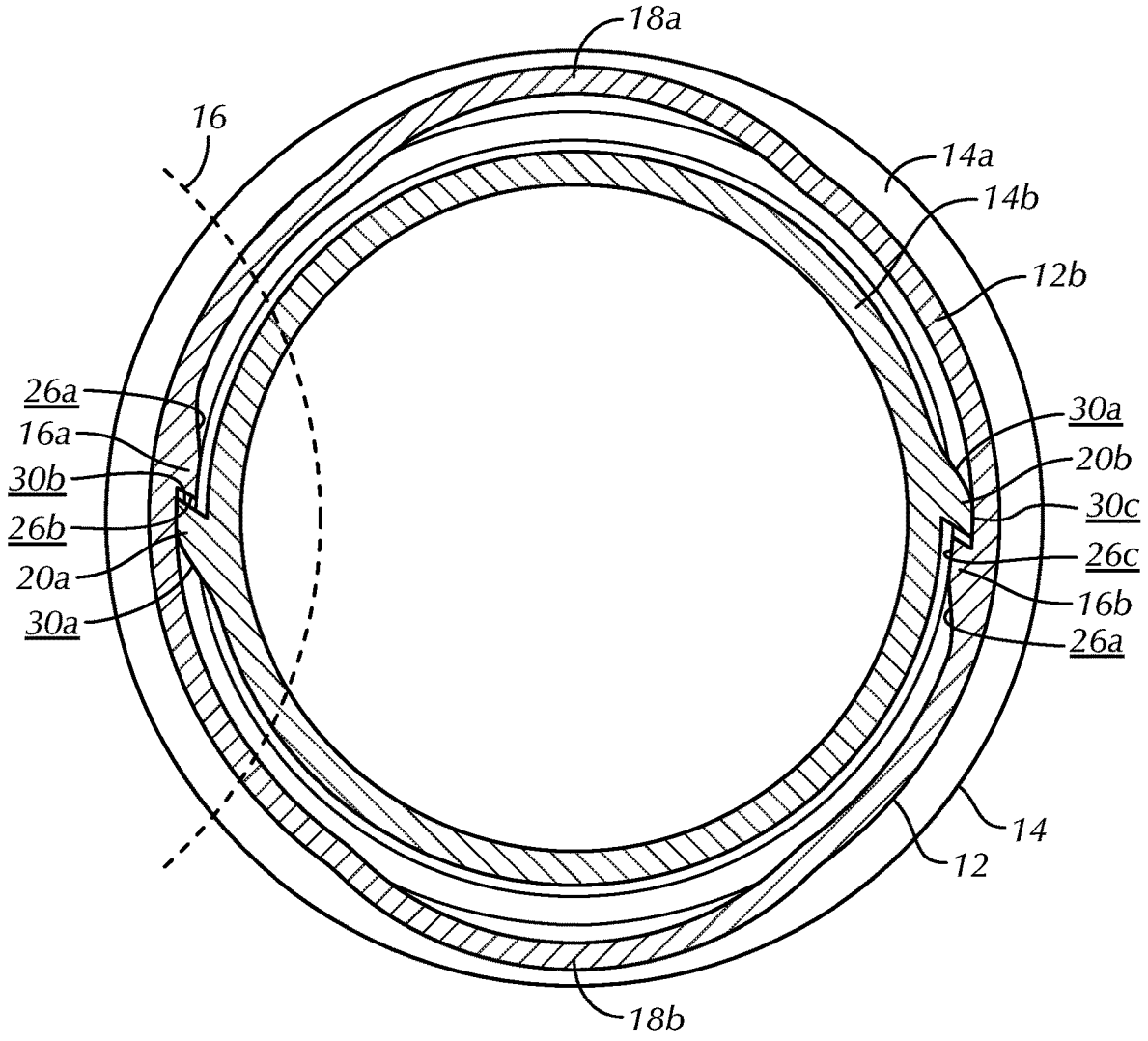
FIG. 15 is a cross-sectional view of the container assembly of FIG. 1, taken along line Z-Z of FIG. 1, wherein the cap is positioned relative to the container in a locked configuration.
Figure 16:
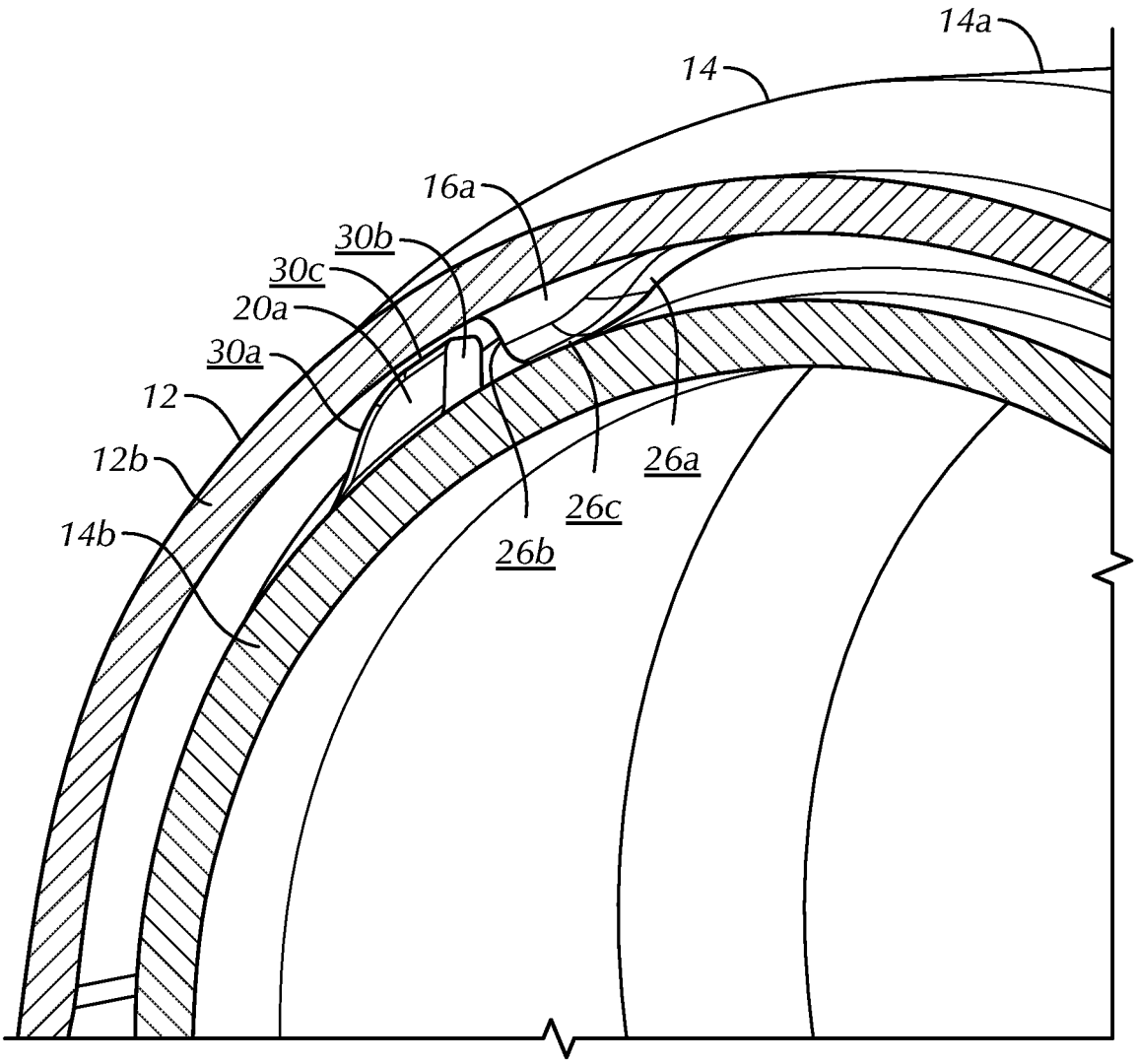
FIG. 16 is a magnified top perspective, cross-sectional view of the container assembly of FIG. 1, taken from within portion 16 of FIG. 15.
Figure 17:
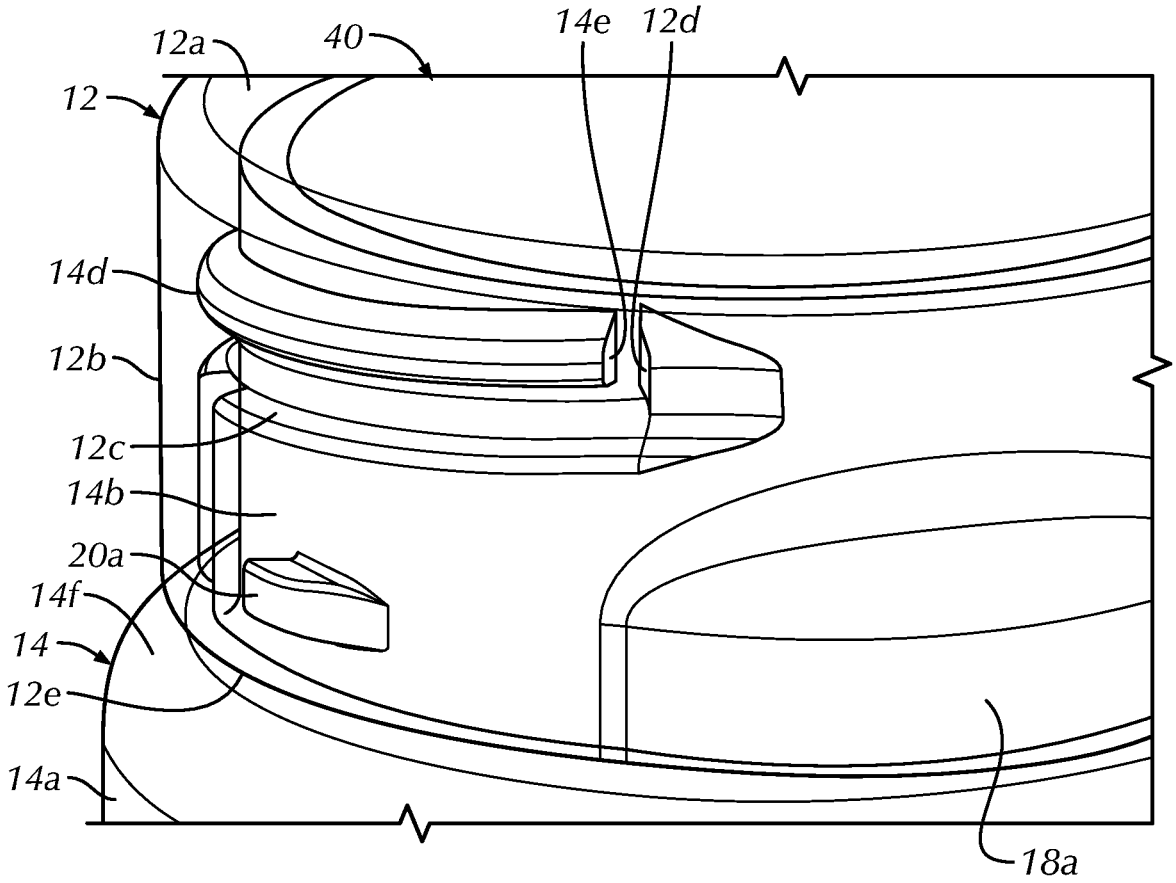
FIG. 17 is a magnified top perspective view of the container assembly of FIG. 1, wherein the cap is partially transparent to show a container rotation-stop lug of container threads of the container and a cap rotation-stop lug of cap threads of the cap in a locked configuration.
Figure 18:
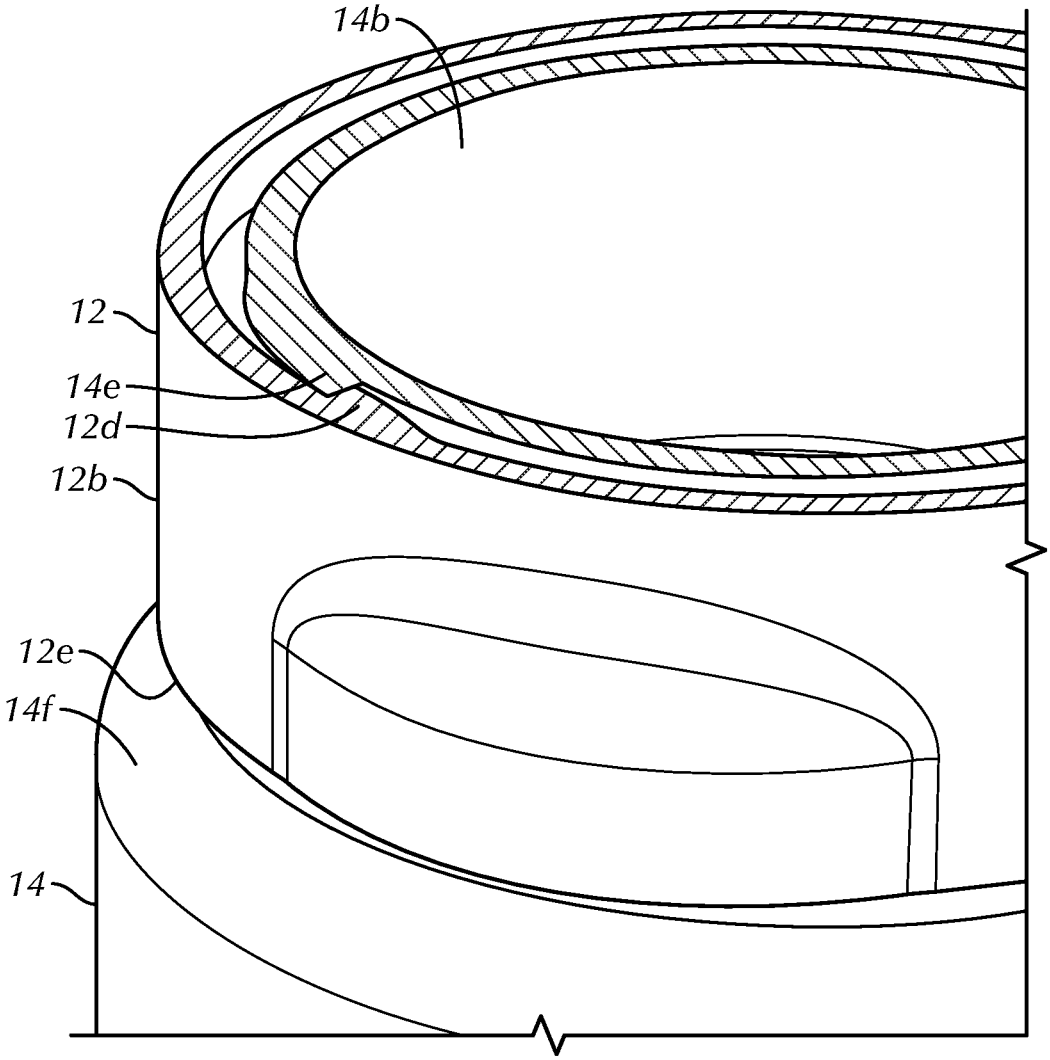
FIG. 18 is a magnified top perspective, cross-sectional view of the container assembly of FIG. 1, taken along line Z-Z of FIG. 1, showing interaction of the cap and closure of FIG. 17 in the locked configuration.

In the preferred embodiment, an inwardly directed force is applied to the first and second bulges 18*a*, 18*b* to urge the first and second cap lugs 16*a*, 16*b* radially outwardly in a release configuration or the squeezed configuration (FIGS. 14 and 15). The first and second bulges 18*a*, 18*b* are squeezed radially inwardly to disengage the first and second cap lugs 16*a*, 16*b* from the first and second container lugs 20*a*, 20*b* in the release configuration such that the cap 12 is pivotable or rotatable relative to the container 14 in an opening direction, which is preferably counterclockwise when viewed from the top and as is shown by the indicia 40 on the top 12*a*, on the cap threads 12*c* and container threads 14*d*.

In the preferred embodiment, the skirt 12*b* is comprised of a single wall, thereby producing an economical closure of relatively limited weight. The single wall skirt 12*b* is relatively economical and has limited weight when compared to known double-walled closures or caps that include more material than the single wall skirt 12*b* of the preferred embodiment, because the prior art caps required the double-walled structure. The cap 12 and container 14 are preferably very easy to operate both for opening and closing, wherein the cap 12 is squeezed at the first and second bulges 18*a*, 18*b* to release the cap 12 from the locked configuration and may be rotated on the cap threads 12*c* and container threads 14*d* in a conventional manner until the container is open. The cap and container 14 are also preferably child resistant.

To replace the cap 12 onto the container 14, the cap 12 is positioned over the mouth 14*c* of the container 14 by urging the top 12*a* toward the mouth 14*c* and rotating the cap 12, preferably in the clockwise direction when viewed from the top (FIG. 6), until a clearly audible click is heard, indicating that the cap 12 is in the secure and closed position. The audible click is created when the first and second cap locking lugs 16*a*, 16*b* clear the locking surfaces 30*b* of the container lugs 20*a*, 20*b* such that the skirt 12*b* flexes from a squeezed configuration (FIGS. 3, 5, 13 and 14) or a configuration where the first and second cap locking lugs 16*a*, 16*b* slide over the first and second container lugs 20*a*, 20*b* into its relaxed configuration (FIGS. 1, 2 and 7-9), wherein the first and second cap locking lugs 16*a*, 16*b* are positioned adjacent to an outer surface of the neck 14*b*. As is specifically seen in FIG. 8, the first and second cap locking lugs 16*a*, 16*b* are positioned adjacent the outer surface of the neck 14*b* in the relaxed configuration and the first and second cap locking lugs 16*a*, 16*b* preferably create the audible click by impacting the outer surface of the neck 14*b* or inner surface of the skirt 12*b* contacting the container lugs 20*a*, 20*b* after the first and second cap lugs 16*a*, 16*b* snap over and clear the container lugs 20*a*, 20*b*. After the audible click is produced, further clockwise rotation of the cap 12 is prevented or limited relative to the container 14 by the flat surface of the cap rotation-stop lugs 12*d* making contact with the container rotation-stop lugs 14*e* while the container assembly 10 is in the locked configuration. In the locked configuration, the closure assembly 10 is generally child resistant, limiting access to contents within the container 14. For example, the container 14 may be filled with contents, such as medication, tablets, caplets or other forms of medication, including a powder for drug reconstitution.

The preferred container assembly 10 does not require any extraordinary movements to close or open the closure 12 on the container 14, but only squeezing the first and second bulges 18*a*, 18*b* and pivoting the cap 12 relative to the container 14 a relatively short distance, preferably a quarter-turn relative to the longitudinal axis or ninety degrees, to allow the first and second container lugs 20*a*, 20*b* to clear the first and second cap locking lugs 16*a*, 16*b* during counter-clockwise pivoting of the cap 12 relative to the container 14 on the cap and container threads 12*c*, 14*d*. The cap 12 preferably provides an audible click when rotated onto and closed onto the container 14 in the locked configuration that indicates to the user that the cap 12 is secure and in the locked configuration. The container assembly 10 preferably does not depend on a minimum torque to achieve child resistance for opening.

The container 14 includes the opposing and protruding container lugs 20*a*, 20*b* extending from the neck 14*b* that are co-molded with the container 14. The container lugs 20*a*, 20*b* provide the locking mechanism that assists in providing the audible click when the cap 12 is applied to the container 14, as described above. The cap 12 includes the counterpart opposing first and second cap lugs 16*a*, 16*b* that will hit the container lugs 20*a*, 20*b* when being opened or attempting to be opened without squeezing the first and second bulges 18*a*, 18*b*. The cap lugs 16*a*, 16*b* are spread apart when force is applied inwardly to the sidewalls of the closure at the bulges 18*a*, 18*b*, thereby causing the cap lugs 16*a*, 16*b* to flex to extend outwardly relative to the longitudinal axis 13.

Figure 11:
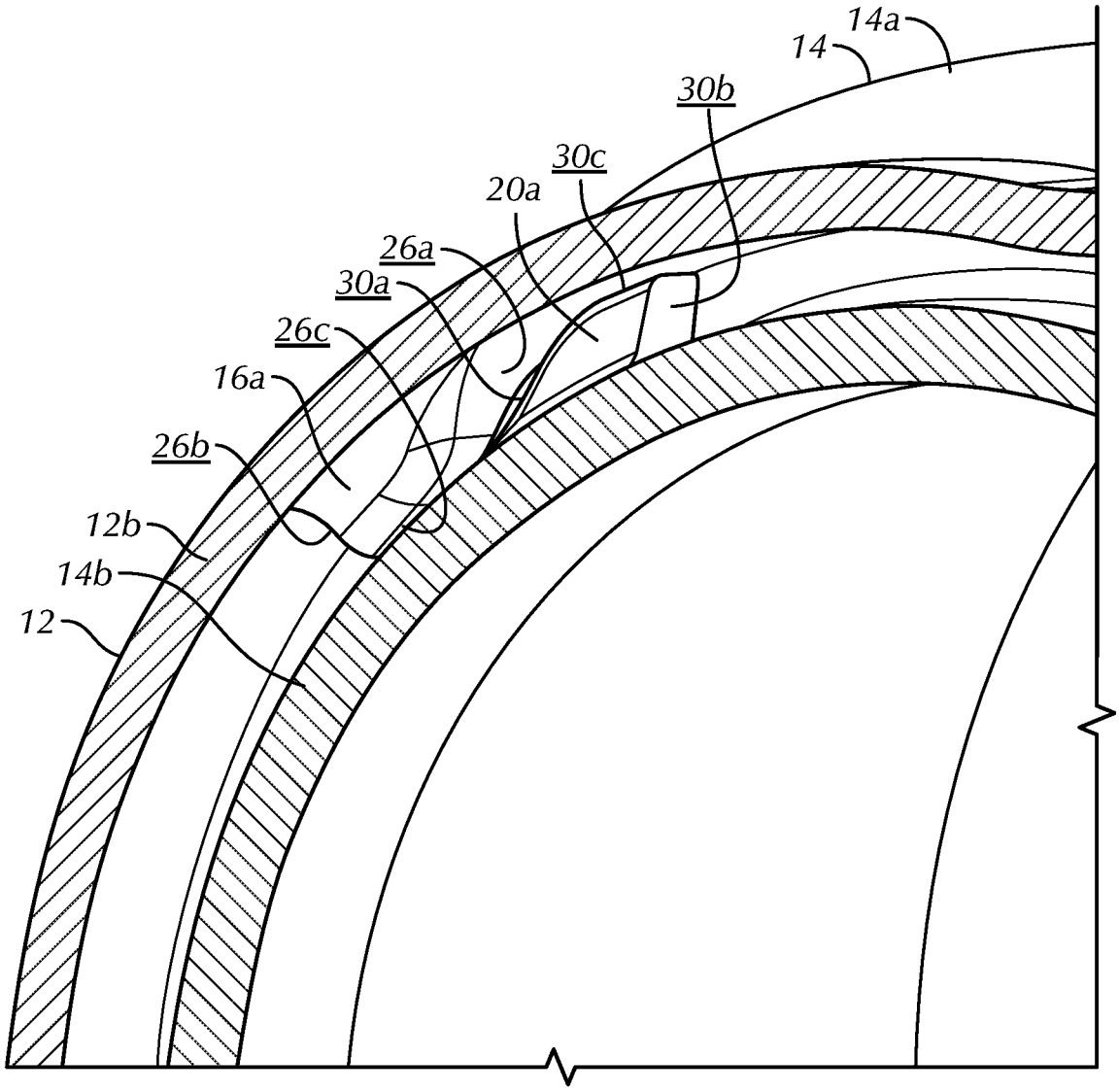
FIG. 11 is a magnified cross-sectional view of the container assembly of FIG. 1, taken from within portion 11 of FIG. 10.

Referring to FIGS. 11-17, the preferred first and second cap lugs 16*a*, 16*b* and the first and second container lugs 20*a*, 20*b* have a hump-like shape when viewed from their side (e.g. FIG. 11). The preferred first and second cap lugs 16*a*, 16*b* include cap ramp surfaces 26*a*, cap locking surfaces 26*b* and cap lug peak surfaces 26*c*. The preferred first and second container lugs 20*a*, 20*b* include container ramp surfaces 30*a*, container locking surfaces 30*b* and container lug peak surfaces 30*c*. The first and second cap and container lugs 16*a*, 16*b*, 20*a*, 20*b* are not limited to having the shapes and configurations shown in the attached drawings, but these shapes are preferred for manufacturing and the function of these components, as is described herein.

Figure 12:
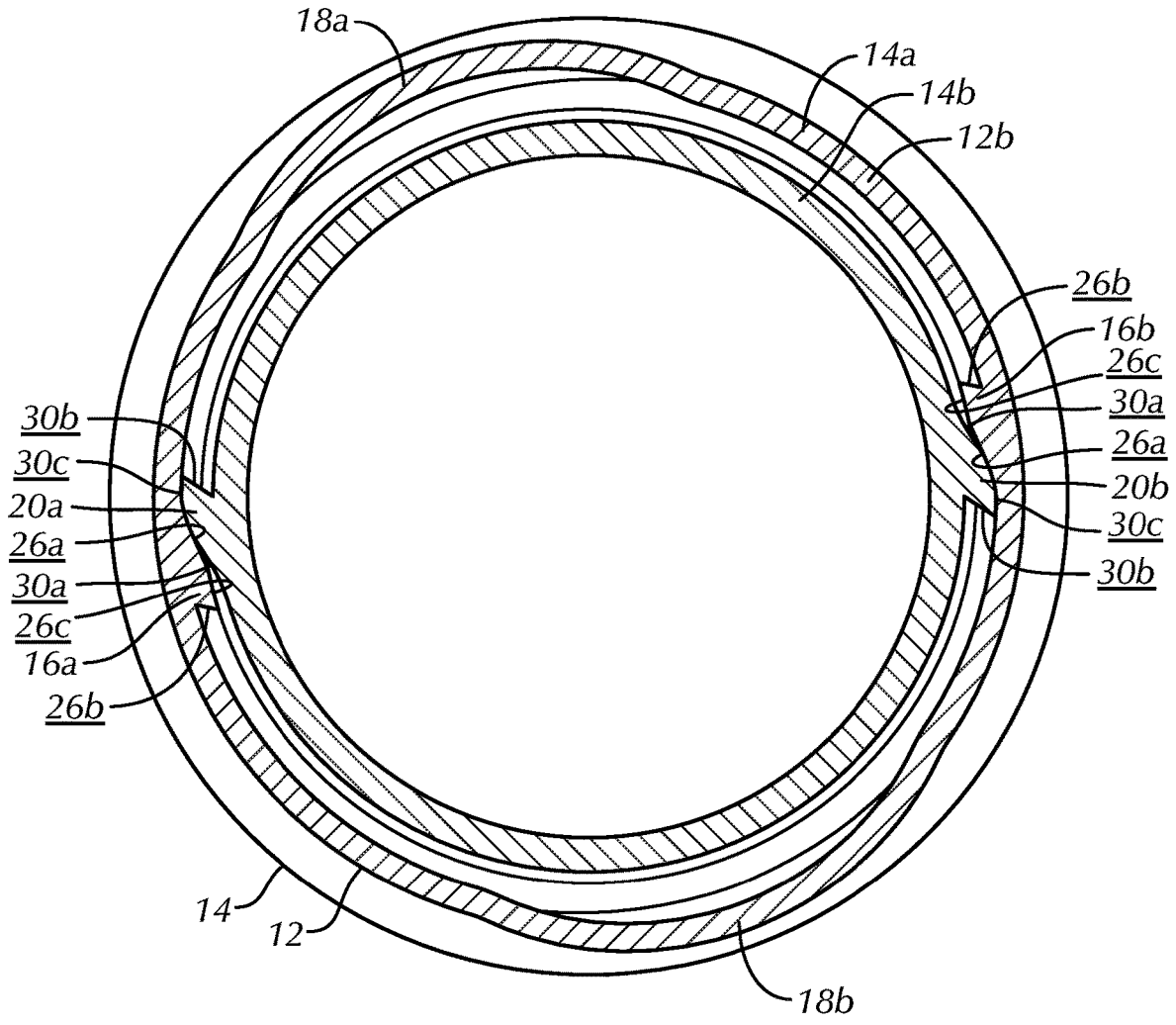
FIG. 12 is a cross-sectional view of the container assembly of FIG. 1, taken along line Z-Z of FIG. 1, wherein the cap is pivoted relative to the container to engage cap ramp surfaces of the cap lugs with container ramp surfaces of the container lugs.
Figure 13:
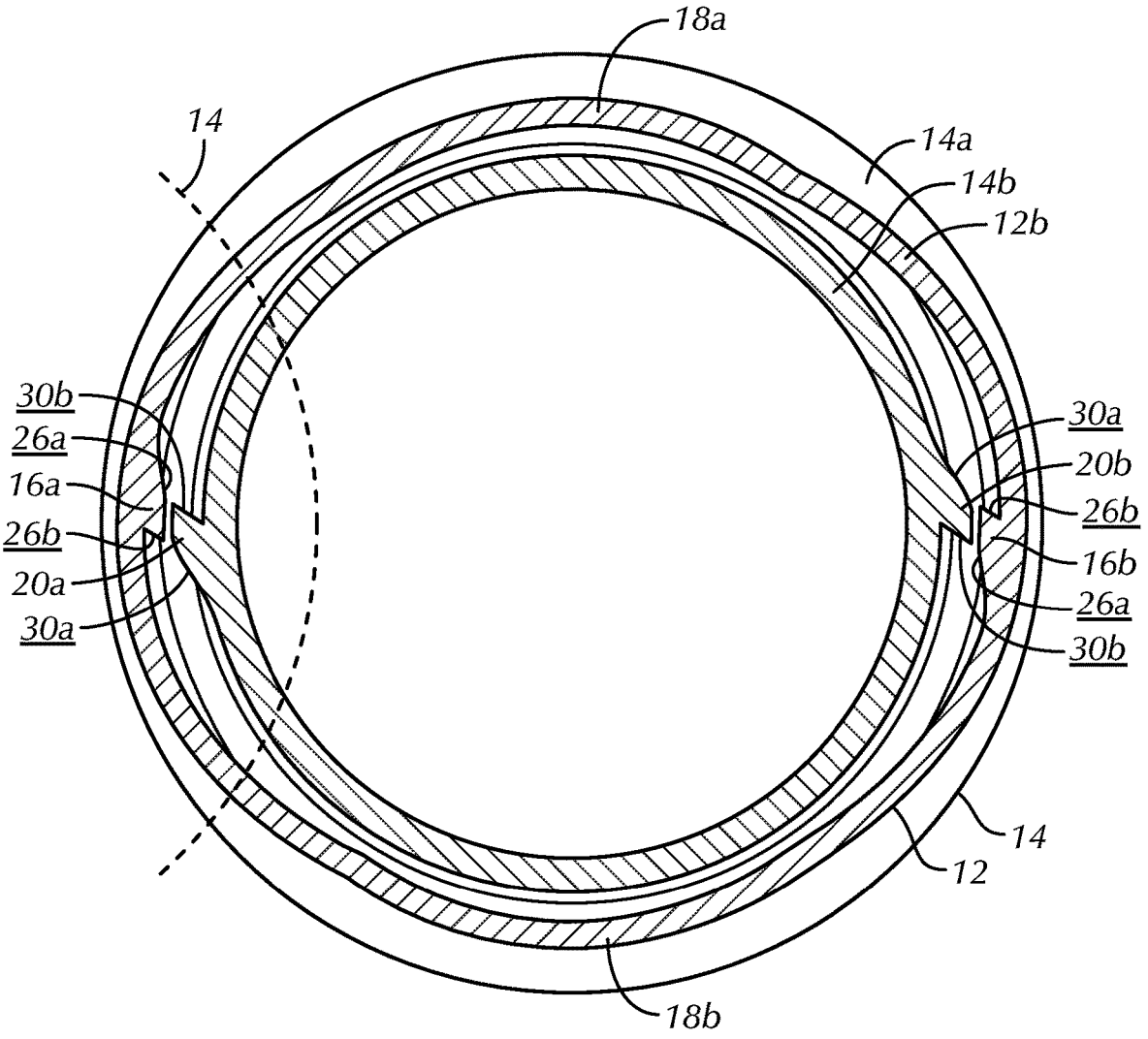
FIG. 13 is a cross-sectional view of the container assembly of FIG. 1, taken along line Z-Z of FIG. 1, wherein the cap is in a squeezed configuration and the cap is pivoted relative to the container such that cap lug peak surfaces of the cap and container lug peak surfaces of the container are positioned adjacent to each other with the cap lug peak surfaces being spaced radially outwardly relative to the container lug peak surfaces.

In use, the cap 12 is positioned over the mouth 14*c* such that the cap threads 12*c* engage the container threads 14*d* and the cap 12 is pivoted or rotated relative to the container 14 in the closing direction, preferably as is indicated by indicia 40 on the top 12*a* in a clockwise direction when viewed from the top. As the cap 12 is rotated in the closing direction with the threads 12*c*, 14*d* engaged, the cap ramp surfaces 26*a* approach and subsequently engage the container ramp surfaces 30*a* (FIGS. 11-13). The ramp-like shape of the cap and container ramp surfaces 26*a*, 30*a* and continued rotation of the cap 12 relative to the container 14 in the closing direction causes the skirt 12*b* to flex outwardly at the first and second cap locking lugs 16*a*, 16*b* and inwardly at the bulges 18*a*, 18*b* with a majority of the flexing occurring near the terminal end 12*e* of the skirt 12. Proximate the top 12*a*, flexing is relatively minimal and the cap and container threads 12*c*, 14*d* remain engaged. The skirt 12*b* is configured to flex, such that a reasonable amount of rotational force applied by the user in the closing direction facilitates the flexing and sliding of the cap and container ramp surfaces 26*a*, 30*a* on each other until the cap and container lug peak surfaces 26*c*, 30*c* are in contact. Continued rotating of the cap 12 relative to the container 14 in the closing direction results in the cap and container lug peak surfaces 26*c*, 30*c* passing each other and the skirt 12*b* causing the first and second cap locking lugs 16*a*, 16*b* to snap inwardly and the first and second bulges 18*a*, 18*b* to snap outwardly. This return of the skirt 12*b* to its generally cylindrical relaxed configuration creates an audible snap, notifying the user that the cap 12 is in the locked configuration with the cap locking surfaces 26*b* of the first and second cap lugs 16*a* facing the container locking surfaces 30*b* of the first and second container lugs 20*a*, 20*b* in the locked configuration. The cap and container locking surfaces 26*b*, 30*b*, which extend generally perpendicularly relative to the longitudinal axis 13 to slightly toward each other proximate the cap and container lug peak surfaces 26*c*, 30*c* generally prevent pivoting of the cap 12 relative to the container 14 in the opening or counterclockwise direction when they are in the locked configuration without squeezing the bulges 18*a*, 18*b*.

Attempts to open the container assembly 10 in the locked configuration (FIG. 15) by rotating the cap 12 in the opening direction, preferably the counterclockwise direction when viewed from the top as indicated by the indicia 40 on the top 12*a*, results in the cap and container locking surfaces 26*b*, 30*b* engaging and preventing the opening rotation of the cap 12 relative to the container 14. As was described above, to open the container assembly 10, the cap 12 is squeezed at the first and second bulges 18*a*, 18*b*, thereby causing the first and second cap lugs 16*a*, 16*b* to extend radially outwardly and the first and second bulges 18*a*, 18*b* to move radially inwardly toward the longitudinal axis 13 such that the cap peak surfaces 26*c* are positioned further radially outwardly from the longitudinal axis 13 than the container ramp surfaces 30*b* (FIG. 13). The user may then rotate the cap 12 relative to the container 14 in the opening direction without the cap and container locking surfaces 26*b*, 30*b* engaging and preventing rotation of the cap 12 relative to the container 14. The cap 12 is preferably rotated approximately one-quarter turn or ninety degrees relative to the container 14 to release the cap and container threads 12*c*, 14*d* from each other to remove the cap 12 from the container 14 to gain access to the contents.

In operation, the skirt 12*b* includes the internal threads 12*c* that engage the external threads 14*d* of the container 14. The skirt 12*b* further includes the cap rotation-stop lugs 12*d* located at the trailing end of the internal threads 12*c* that may interact with the container rotation-stop lugs 14*e* during a closing rotation to prevent over-rotation of the cap 12 relative to the container 14. The skirt 12*b* also includes the first and second cap lugs 16*a*, 16*b* that interact with the first and second container lugs 20*a*, 20*b*. Accordingly, the flexible skirt 12*b* that flexes for opening and closing the container assembly 10 also includes the internal threads 12*c* for engaging the external threads 14*d*, the first and second cap lugs 16*a*, 16*b* that cooperate with the first and second container lugs 20*a*, 20*b* and the cap and container rotation-stop lugs 12*d*, 14*e* that prevent over-rotation to facilitate the child resistant function of the preferred container assembly 10. This construction is distinctly different than known double-walled design closure assemblies or known closure assemblies that are significantly taller, wherein the threads of the cap are typically isolated from the component of the cap that is deformed or utilized to facilitate the child resistant locking feature. The skirt 12*b* of the preferred cap 12 is, accordingly, flexed or deformed in such a way as to deform the shape and position of the internal threads 12*c*, but only to the extent that they are still functional for engagement with the external threads 14*d* of the container 14 during use. The configuration of the skirt 12*b*, including the first and second bulges 18*a*, 18*b* positioned near the lower edge of the skirt 12*b*, the positioning of the internal threads 12*c* near the top 12*a* and the positioning of the first and second cap lugs 16*a*, 16*b* near the lower edge of the skirt 12*b* facilitates continued functioning of the internal threads 12*c* with the external threads 14*d* and operation of the child resistant features of the container assembly 10.

The shape of the skirt 12*b* and the bulges 18*a*, 18*b*, as well as the positioning of the threads 12*c*, the first and second cap lugs 16*a*, 16*b* and the bulges 18*a*, 18*b* facilitates functioning of the preferred container assembly 10, as was described herein. Specifically, positioning the bulges 18*a*, 18*b* and the first and second cap lugs 16*a*, 16*b* near the lower edge of the skirt 12*b* permits relatively large radial displacements of the bulges 18*a*, 18*b* and the first and second cap lugs 16*a*, 16*b* relative to the longitudinal axis 13 and comparatively minimal radial deformation of the internal threads 12*c* that are positioned near the top 12*a*. The relatively minimal deformation of the threads 12*c* facilitates continued functioning and engagement between the internal threads 12*c* on the skirt 12*b* and the external threads 14*d* on the cap 14. Similarly, so that the external threads 14*d* cooperate and engage the internal threads 12*c* and the first and second cap lugs 16*a*, 16*b* cooperate with the first and second container lugs 20*a*, 20*b*, the external threads 14*d* are positioned near the mouth 14*c* and the first and second container lugs 20*a*, 20*b* are positioned near the base of the neck 14*b*. In the relaxed configuration, the entire skirt 12*b* has a generally cylindrical-shape, while in the squeezed configuration, the skirt 12*b* has a generally cylindrical-shape near the top 12*a* and an elliptical-shape near the terminal end 12*e* with the bulges 18*a*, 18*b* positioned near the co-vertices of the ellipse and the first and second cap locking lugs 16*a*, 16*b* positioned near the opposing vertices of the ellipse.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

We claim:

1. A container assembly wherein an operator squeezes opposing sides toward a longitudinal axis to open the container assembly, the container assembly comprising:

a cap consisting of a top and a peripheral skirt extending from the top to a free, terminal end, the skirt having a first bulge and a second bulge, inner surfaces of the first and second bulges extending radially outwardly a greater distance relative to the longitudinal axis compared to a remainder of an inner surface of the skirt, the first bulge positioned opposite the second bulge on the skirt, the cap also including first and second cap lugs extending inwardly from the skirt, the first cap lug positioned opposite the second cap lug on the skirt and the first and second cap lugs being spaced from the first and second bulges, the first and second cap lugs and the first and second bulges positioned proximate a terminal end of the skirt, the cap including cap threads extending inwardly from the inner surface of the skirt; and a container having a body and a narrowed neck extending from the body, the neck defining a mouth at a top end of the neck, the container including first and second container lugs extending radially outwardly from the neck, the first container lug positioned opposite the second container lug on the neck, the first and second cap lugs interacting with the first and second container lugs to block pivoting of the cap relative to the container in a locked configuration when the cap is in a relaxed configuration, the container including container threads extending from the neck proximate the mouth that are engaged with the cap threads in the locked configuration.

2. The container assembly of claim 1, wherein an inwardly directed force is applied to the first and second bulges to urge the first and second cap lugs radially outwardly in a release configuration.

3. The container assembly of claim 1, wherein the first and second bulges are squeezed radially inwardly to disengage the first and second cap lugs from the first and second container lugs in a release configuration.

4. The container assembly of claim 1, wherein the cap and container are configured for opening and closing.

5. The container assembly of claim 1, wherein the cap and container produce an audible click to alert the operator that the cap is in the locked configuration when the cap moved from a squeezed configuration to the locked configuration when securing the cap to the container.

6. The container assembly of claim 1, wherein the first and second bulges and the first and second cap lugs are positioned proximate the terminal end of the skirt and the first and second container lugs are positioned proximate a shoulder of the container.

7. The container assembly of claim 1, wherein the cap threads are comprised of internal threads positioned proximate the top and the container threads are comprised of external threads positioned proximate the mouth.

8. The container assembly of claim 1, wherein the cap threads include first cap threads and second cap threads, the first cap threads extending radially inwardly from an opposite side of the skirt than the second cap threads.

9. The container assembly of claim 8, wherein the first bulge is positioned between the first and second cap threads and the second bulge is positioned between the first and second cap threads, respectively.

10. The container assembly of claim 8, wherein the first and second cap threads are positioned closer to the top than the first and second cap locking lugs and the first and second bulges.

11. The container assembly of claim 1, wherein the cap and container include rotation-stop lugs that limit overtightening of the cap onto the container.

12. The container assembly of claim 1, wherein the container threads are comprised of external threads, the external threads have a container rotation-stop lug at a leading end of the external threads, the cap threads comprised of internal threads, the internal threads having a cap rotation-stop lug at a trailing end of the internal threads.

13. The container assembly of claim 1, wherein the first and second container lugs each include a container ramp surface, a container locking surface and a container lug peak surface.

14. The container assembly of claim 1, wherein the first and second cap lugs each include a cap ramp surface, a cap locking surface and a cap lug peak surface.

15. A child resistant closure assembly for limiting access to contents, the closure assembly comprising:

a cap consisting of a top and a peripheral skirt extending from the top to a free, terminal end, the skirt having a first bulge and a second bulge with inner and outer surfaces extending radially outwardly relative to a longitudinal axis further than inner and outer surfaces of the remainder of the skirt, the first bulge positioned opposite the second bulge on the skirt, the cap also including first and second cap lugs extending inwardly from the skirt, the first cap lug positioned opposite the second cap lug on the skirt and the first and second cap lugs being spaced from the first and second bulges, the first and second cap lugs and the first and second bulges positioned proximate a terminal end of the skirt, the cap including cap threads extending inwardly from the inner surface of the skirt, the cap threads positioned proximate the top, the first and second cap lugs including cap ramp surfaces, cap locking surfaces and cap lug peak surfaces; and a container having a body and a narrowed neck extending from the body, the neck defining a mouth at a top end of the neck, the container including first and second container lugs extending radially outwardly from the neck, the first container lug positioned opposite the second container lug on the neck, the first and second container lugs positioned proximate a shoulder of the container and being spaced from the mouth, the first and second container lugs including container ramp surfaces, container locking surfaces and container lug peak surfaces, the first and second cap lugs interacting with the first and second container lugs to block pivoting of the cap relative to the container in a locked configuration when the cap is in a relaxed configuration, the cap locking surface of the first cap lug faces the container locking surface of the first container lug in the locked configuration, the container including container threads extending from the neck proximate the mouth.

16. The closure assembly of claim 15, wherein the first and second container lugs are co-molded with the container from a polymeric material.

17. The closure assembly of claim 15, wherein the first and second cap lugs are co-molded with the cap from a polymeric material.

18. The closure assembly of claim 15, wherein the cap threads and the container threads are quarter-turn threads.

19. The closure assembly of claim 15, wherein the cap lug peak surfaces are positioned radially outwardly relative to container lug peak surfaces in a squeezed configuration.

* * * * *